United States Patent [19]

Metje

[11] 4,173,137

[45] Nov. 6, 1979

[54] BENDING FIXTURE FOR OFFSET PLATES

[76] Inventor: Heinz Metje, Mittelstrasse 21, 5630 Leichlingen, Fed. Rep. of Germany

[21] Appl. No.: 809,429

[22] Filed: Jun. 23, 1977

[30] Foreign Application Priority Data

Jun. 24, 1976 [DE] Fed. Rep. of Germany ..... 2628249

[51] Int. Cl.[2] ..... B21D 25/04; B21D 5/04

[52] U.S. Cl. ..... 72/320; 101/415.1

[58] Field of Search ..... 101/415.1, 378, DIG. 12; 72/319, 320, 321, 322, 323, 306

[56] References Cited

U.S. PATENT DOCUMENTS

| | | | |
|---|---|---|---|
| 1,806,986 | 5/1931 | Rucker | 72/321 |
| 2,234,170 | 3/1941 | Huck | 72/321 |
| 2,699,812 | 1/1955 | McCormack et al. | 72/320 |
| 3,022,728 | 2/1962 | Heller | 101/415.1 |
| 3,383,899 | 5/1968 | Ercoline et al. | 72/319 |
| 3,456,587 | 7/1969 | Hulen | 101/415.1 |
| 3,735,627 | 5/1973 | Eburn | 72/319 |
| 3,877,279 | 4/1975 | Van Cleave | 72/319 |
| 3,914,974 | 10/1975 | DeVore | 72/319 |

FOREIGN PATENT DOCUMENTS

| | | | |
|---|---|---|---|
| 817308 | 10/1951 | Fed. Rep. of Germany | 101/415.1 |
| 2045953 | 3/1972 | Fed. Rep. of Germany | 101/DIG. 12 |

*Primary Examiner*—J. Reed Fisher

*Attorney, Agent, or Firm*—Friedman, Goodman & Teitelbaum

[57] ABSTRACT

A bending fixture for offset plates provided with positioning holes, the bending fixture including a platform having bending bars pivotally mounted at opposite ends thereof and plate hold-down members coacting therewith, where the hold-down members are raised away from and lowered toward the platform during their operation. The bending bars swing upward above the platform with one of the bars being provided with retractable positioning pins arranged along the one bar. Each hold-down member includes an edge surface to provide an abutment for the bent over edge of the plate in order to back up its associated bending bar.

9 Claims, 7 Drawing Figures

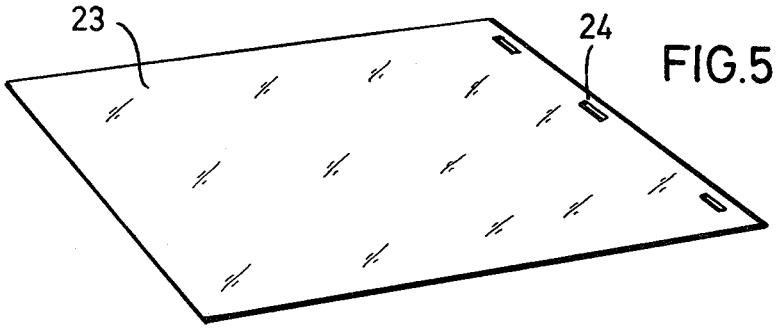
FIG.5
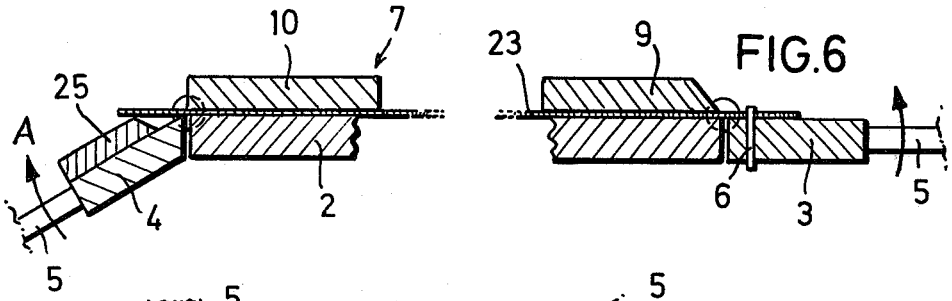
FIG.6
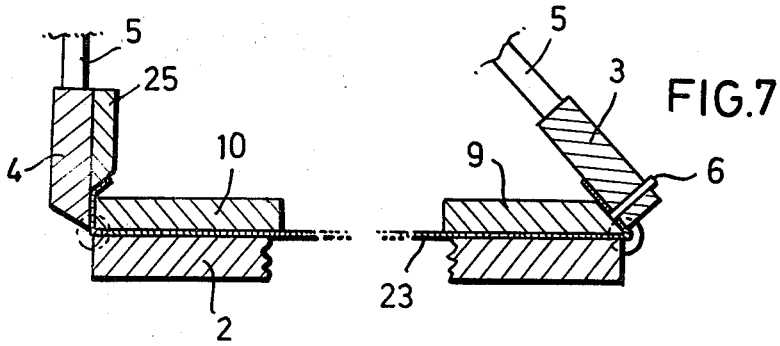
FIG.7
FIG.4
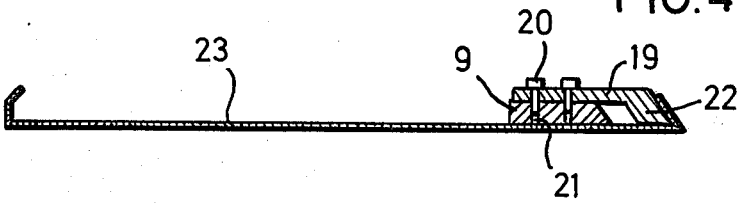

BENDING FIXTURE FOR OFFSET PLATES

BACKGROUND OF THE INVENTION

The present invention relates to a bending fixture for offset plates provided with positioning holes, including a platform with bending bars pivoted to two opposite ends thereof and a plate hold-down device capable of being raised and lowered relative to the platform for holding down an offset plate.

There is a known positioning system for fitting plates on offset cylinder presses, comprising a bending fixture with positioning pins to position a plate provided with positioning holes. However, this system is preset to handle only one size plate, where the positioning pins are fixed in place.

SUMMARY OF THE INVENTION

The object of the present invention is to provide a bending fixture compatible with the above mentioned system, permitting easy handling and moreover being suitable for bending all current printing plates alike, with one and the same fixture.

Accordingly, it is another object of the present invention to provide an improved bending fixture which overcomes the disadvantages of the prior art.

According to the present invention, this is accomplished by the bending bars being pivoted to swing upward, and by the retractable positioning pins along the corresponding bar being arranged in the bending area of the plate in front of one end of the platform, and by the hold-down device having at least one positioning rail member at each end of the platform to act as a backstop for the bar associated therewith.

Bending upward, especially in conjunction with the use of the positioning pins, is advantageous because the pins will not permit a downward swinging motion if they are so arranged that they are to engage positioning holes located in the bending area of the plate. At the same time, the number of positioning pins is adjusted to the number of holes in the particular plate.

The fixture according to the present invention, is so proportioned that its platform is precisely adjusted to a particular plate measurement, so that the edges of the ends of the platform will directly determine the crease of the plate at its two ends, without requiring any displacement of the plate on the platform. Therefore, according to the present invention, the positioning rail members, which act to backstop the two bending bars, are at the ends of the platform, in such a manner that their anterior edges are exactly flush with each corresponding anterior edge of the platform. The two positioning rail members are perfectly rigid, so that no dimensional change is possible.

According to the present invention, it is advantageous for the positioning pins to be disposed in the bending bar. It is then expedient, in application of this invention, if the bar associated with the pins occupies a horizontal position at rest, representing a prolongation of the platform surface. Then the plate may be slipped directly onto the positioning pins, and the result is a precise orientation of the plate on the platform. After the plate hold-down device is lowered, the positioning pins are depressed, for example by hand, so that they are recessed in the bending bar, and the bending bar can be swung upward without any interference with the bending operation being caused by the positioning pins.

After bending, the pins are again elevated, for example by hand, to receive the next plate.

If the bending operation is to be automated as far as possible, it may be desirable for the positioning pins to be arranged with portions thereof extending outwardly from underneath the bending bar, in order to be capable of being raised and lowered by a hydraulic or pneumatic cylinder, the pins being disposed in matching holes in the bending bar.

Further, it may be desirable for the positioning pins to be adapted to the width of the positioning holes in the plate, with the pins being shorter than the hole width. Such an adaptation of the positioning pins to the positioning holes in the plate affords a permanently reproducible orientation of the plate in lengthwise direction, i.e. in the direction of printing, on the bending fixture, and provides a crease absolutely parallel to the axis of the cylinder on which the plate is afterwards to be mounted.

In case the fixture according to this invention is also to be used for bending plates that are, in particular, shorter than the platform, then according to the present invention it may be advantageous for the plate hold-down device to have at least one fixed intermediate positioning rail member parallel to those rail members at the ends of the platform. This presupposes, however, that only certain current standard sizes of plates are to be bent, so that the distance of the intermediate positioning rail member or members from the posterior positioning rail member, corresponding to the distance between creases of the plate when bent at both ends, is preassigned in each instance, whereby the fixed arrangement of the intermediate positioning means and the positioning rail members at the end of the hold-down device is readily possible. In case all known plate sizes are to be bent with the same fixture according to the present invention, and the latter fixture is designed for the largest plate measurement, a corresponding number of fixed intermediate positioning rail members must be provided.

In the above latter case, the plate is first oriented with the aid of the positioning pins and then fixed on the platform with the hold-down device. Then the positioning pins are lowered into the bar and the plate is bent over at the head end, that is, the end where the positioning pins are located. After that, the hold-down device is raised and the plate, bent over at one end, is pushed to the rear of the platform until the crease is brought into contact with the intermediate positioning rail member corresponding to the plate measurement. At the same time, precision contact is easily verified, since the bend has been made upward, so that visual inspection is entirely feasible. When the hold-down device has been lowered once more, the tail end of the plate is bent over with the other, posterior bending bar.

If, on the other hand, the bending fixture according to this invention is laid out for an intermediate size of plate, it is advantageous, to be able to place a widening member of L-shaped cross section on the front positioning rail member, with the shorter free flange of the L-shaped member having a contact surface beveled according to the desired bending angle. For in this latter case, plates of larger size, i.e. longer than those for which the fixture is designed, may be bent by horizontally pulling out a plate, already bent at the anterior end, beyond the platform onto the horizontal bending bar and bringing it into contact with the anterior positioning rail member, where this latter rail member has been widened by the above mentioned widening member in the direction of the bending bar by the amount of the excess measurement of the plate. After again lowering the hold-down device, the other end of the plate is then bent over.

If the plate is to be bent twice or more at the posterior end, i.e. the end opposed to the positioning holes, then it may be desirable for that purpose, in application of this invention, for a supplementary bending member to be superimposable on the posterior bending bar.

Accordingly, a bending fixture thus is obtained that firstly makes possible exact positioning of the plates in lengthwise direction on the platform, and hence a bending of the plate absolutely parallel to the center line in terms of the orientation of the plate on the cylinder of a press, and that secondly is suitable for bending all current sizes of plates alike; and this versatility is achieved without departing from the principle of a rigid positioning, in which the essence of the present invention consists.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of the preferred embodiment in which:

FIG. 4 shows a partial view in section of an anterior positioning rail member provided with a widening member;

FIG. 5 shows a perspective view of a plate to be bent on the fixture;

FIG. 6 shows a partial view in section of the bending fixture with the hold-down device lowered on the plate before bending;

FIG. 7 shows a partial view in section of the bending fixture with the hold-down device lowered on the plate after bending of both ends of the plate.

In the various figures of the drawings, like reference characters designate like parts.

DESCRIPTION OF THE PREFERRED EMBODIMENT

Figure 1:
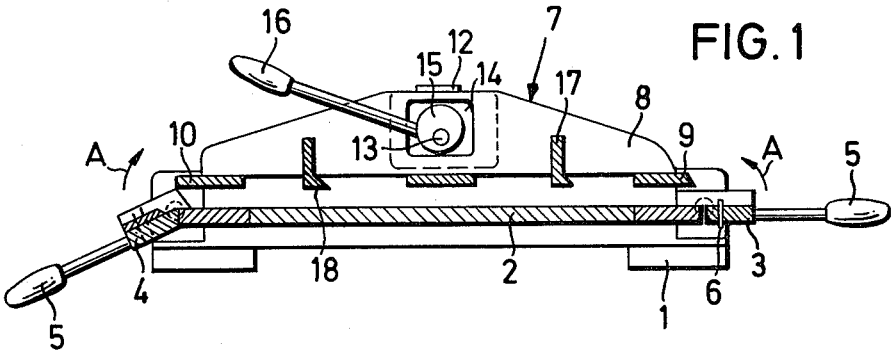
FIG. 1 shows a sectional view of a bending fixture according to the present invention.
Figure 2:
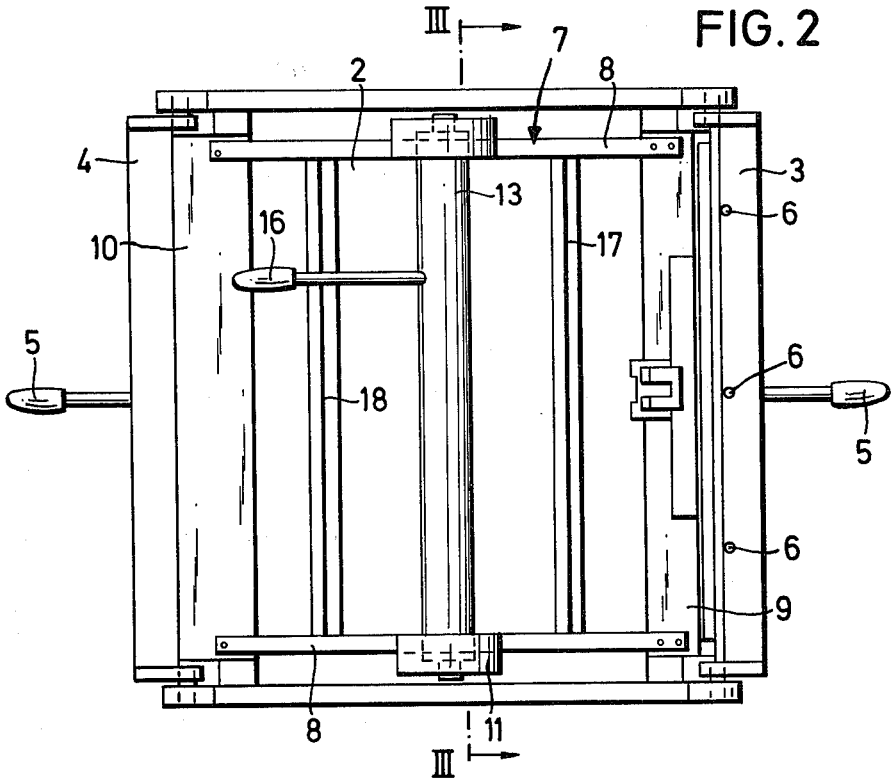
FIG. 2 shows a top view of the fixture shown in FIG. 1.
Figure 3:
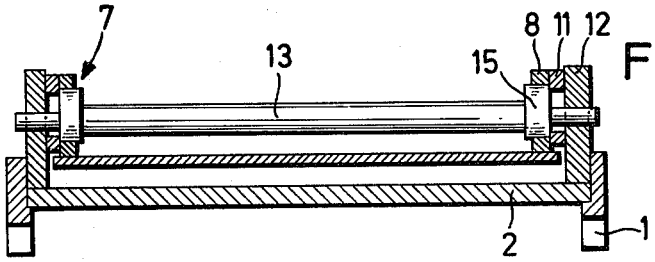
FIG. 3 shows a sectional view taken along the line III—III of FIG. 2.

A bending fixture according to the present invention, as shown in FIGS. 1–3, includes a frame 1 to which is conventionally fixed a platform 2. The platform 2 has a width corresponding to the width of the plates being used, for example 522 mm. At opposite ends of the length of platform 2, an anterior bending bar 3 and a posterior bending bar 4 are pivoted, being capable of swinging upward above the platform, see arrows A. Bars 3, 4 are actuable manually by means of attached handles 5. Alternatively, however, the bars may, for example, be actuated hydraulically or the bars may be motorized.

In the anterior bar 3, in the example shown, three positioning pins 6 are retractably arranged spaced along the bar's length. As required during the operation, the pins 6 can be partially retracted from or pushed into the bending bar. A further embodiment may advantageously include that the pins are arranged to extend outwardly from underneath the bending bar, being raised or lowered from underneath the bar by automatic means, hydraulically or pneumatically for example, such automatic means being well known in the art and therefore a drawing thereof is not thought necessary, where the pins pass through corresponding openings or passages provided in the bar 3.

In rest position, as shown in FIGS. 1 and 6, the anterior bending bar 3 occupies a horizontal position, thus representing a prolongation of the horizontal platform 2. The posterior bending bar 4 assumes a position inclined downward at rest.

Above the platform 2, a hold-down device 7 is arranged, capable of being raised and lowered with respect to the top horizontal surface of the platform. This hold-down device is in the form of a frame and includes two lengthwise members 8 disposed in the same direction as the length of the platform. The ends of the members 8 are joined by an anterior positioning rail member 9 and a posterior positioning rail member 10. The length of positioning rail members 9, 10 corresponds to the width of platform 2, and hence to the maximum width of the plate to be bent, see FIG. 5.

The outer sides or edges of the positioning rail members, which serve as abutments for the bent over edges of the plate, are inclined or beveled according to the particular bending angle desired. In the example shown, the contact surface or edge of the anterior rail member 9 is beleved at an acute angle, while the contact surface or edge of the posterior positioning rail member 10 is vertical to provide a right angle.

The longitudinal members 8 each have central guides 11 for slidably bearing against an associated perpendicular slide post 12. The spaced apart slide posts 12 are conventionally fixed to the base 2, as best shown in FIG. 3. The guides 11 and the slide posts 12 are so fitted together, in a conventional manner well known in the art, that the guides 11 will slide up and down against the posts 12. An actuating shaft 13 is rotatably mounted by having its opposite ends rotatably disposed in the two spaced apart slide posts 12. The shaft 13 passes through rectangular or square holes 14 in the lengthwise members 8. The shaft 13 is provided with a pair of eccentrics 15. Each eccentric 15 is disposed in an associated one of the holes 14 so that when the shaft 13 is turned by a handle 16 attached thereto, the eccentrics 15 will lower or raise the lengthwise members 8 accordingly, and hence the entire hold-down device 7.

The hold-down device 7, in the example shown, also has two intermediate positioning rail members 17, 18, which are attached to the lengthwise members 8 on the left and right side of the midpoints of the members 8. These intermediate positioning means serve to bend plates shorter in length than the length of the platform. As shown in FIG. 1, the contact edges of rail members 17, 18 have the same acute angle as the contact edge of rail member 9. With a suitable number of fixed intermediate positioning rail members on the lengthwise members 8, every known size of plate can be bent if the basic dimensions of the bending machine are adapted to the largest plate size. The lengths of current plate sizes run between 454 and 708 mm.

As FIG. 4 shows, a widening member 19 may be mounted on the anterior positioning rail member 9 by means of pins 20 fitting into corresponding holes 21 in the positioning rail member 9. This widening member is substantially L-shaped, with the shorter flange 22 being shaped to back up the already bent edge of the plate, where the contacting edge of the flange 22 is adapted in inclination to the angle of bending of the plate. This widening member is used when the basic size of the fixture is smaller than the largest plate size, and where a plate larger than the basic size is to be bent.

FIG. 5 shows a conventional plate 23 to be bent with the fixture according to the present invention, the plate being provided at its anterior end, in the example shown, with three positioning holes 24 of rectangular configuration.

FIG. 6 shows the plate 23 being engaged by the pins 6 and being held down on platform 2 by hold-down device 7. In this position, the unbent plate 23 projects beyond the ends of the platform by the length of the portion to be bent over at each end. As is plainly seen, the portion of the plate with the punched holes 24 will thus be bent over, so that these holes will afterwards be located in the cleft of the press cylinder. The posterior bending bar 4 is provided with an auxiliary bending member 25 mounted thereon, for example being screwed in place. The member 25 has a contacting edge with an acute angle and coacts with the bar 4 to bend the posterior end of the plate twice, as indicated for example in FIG. 7. As FIG. 7 also shows, when the anterior end of plate 23 is being bent, the positioning pins 6 are retracted or pushed into the anterior bar 3, so that they do not interfere with the bending operation, where the anterior bending bar 3 can be swung into an adjacent position with the abutting surface of the anterior positioning rail member 9, with the bent end of the plate being sandwiched therebetween.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A bending fixture for offset plates provided with positioning holes, said bending fixture comprising:

a platform having a flat horizontal upper surface for supporting an offset plate;

a first bending bar being disposed at one end of said platform;

a second bending bar being disposed at an opposite end of said platform;

means for pivotally mounting said first and second bending bars relative to said platform for swinging said first and second bending bars upwardly from their rest positions at the opposite ends of said platform to their bending positions above said platform;

retractable pin means disposed in said first bending bar in a bending area of the plate for positioning the plate on said platform, said retractable pin means including pins disposed in a direction along a length of said first bending bar, said pins being disposed in front of said one end of said platform and extending outwardly in an upward direction from an upper surface of said first bending bar when said first bending bar is in its rest position;

hold-down means for holding down the plate on said platform;

means for raising and lowering said hold-down means relative to said upper surface of said platform;

said hold-down means including positioning rail members, a first of said rail members being disposed at said one end of said platform for cooperating with said first bending bar and a second of said rail members being disposed at said opposite end of said platform for cooperating with said second bending bar; and said first and second rail members providing back up abutments for bent over edges of the plate.

2. A bending fixture according to claim 1, wherein one of said first and second bending bars is disposed in a horizontal plane in its rest position which is level with said upper surface of said platform to provide a prolongation of said platform upper surface.

3. A bending fixture according to claim 1, wherein said first bending bar is disposed in a horizontal plane in its rest position with said upper surface of said first bending bar being level with said upper surface of said platform to provide a prolongation of said platform upper surface.

4. A bending fixture according to claim 3, wherein said first rail member is provided with a widening member of L-shaped cross section, a shorter flange of said widening member having an abutting surface beveled to a predetermined angle corresponding to one of the bent over edges of the plate, said abutting surface of said widening member engaging said pins when said first bending bar is in its bending position to push said pins into said first bending bar so that portions of said pins sufficiently extend outwardly from underneath said first bending bar in order for said pins to be raised again when said first bending bar is again positioned in its rest position.

5. A bending fixture according to claim 1, wherein said pins have portions extending outwardly from underneath said first bending bar in order for said pins to be raised and lowered, said first bending bar being provided with matching passages to receive said pins.

6. A bending fixture according to claim 1, wherein said pins have predetermined width sizes to permit passage through the positioning holes in the plate.

7. A bending fixture according to claim 1, wherein said hold-down means includes a third intermediate positioning rail member mounted between and parallel to said first and second rail members disposed at each end of said platform.

8. A bending fixture according to claim 1, wherein one of said first and second rail members is provided with a widening member of L-shaped cross section, a shorter flange of said widening member having an abutting surface beveled to a predetermined angle corresponding to one of the bent over edges of the plate.

9. A bending fixture according to claim 1, wherein one of said first and second bending bars is provided with an additional bending member in order to bend the plate at least twice.

* * * * *